United States Patent [19]

Farrar et al.

[11] Patent Number: 4,483,060

[45] Date of Patent: Nov. 20, 1984

[54] GUN ASSEMBLING AND DISASSEMBLING TOOL

[75] Inventors: Frank W. Farrar, Los Alamitos; Carl J. Cupp, Hawaiian Gardens, both of Calif.

[73] Assignee: Pachmayr Gun Works, Inc., Los Angeles, Calif.

[21] Appl. No.: 450,478

[22] Filed: Dec. 16, 1982

[51] Int. Cl.[3] ..... B25B 27/14

[52] U.S. Cl. ..... 29/278

[58] Field of Search ..... 29/270, 278; 81/3 R, 81/121 B, 900; 33/DIG. 18, DIG. 11, 168 R, 174 H, 180 AT, 181 AT

[56] References Cited

U.S. PATENT DOCUMENTS

| | | | |
|---|---|---|---|
| 1,354,195 | 9/1920 | Jokubaitis | 33/174 |
| 1,645,468 | 10/1927 | Wilke | 33/168 R |
| 2,498,171 | 2/1950 | Michler | 33/168 R |
| 2,558,965 | 7/1951 | Koenig | 33/168 R |
| 2,654,957 | 10/1953 | Grant | 33/168 R |
| 2,682,110 | 6/1954 | Muiza | 33/168 R |
| 3,045,354 | 7/1962 | Fravenholtz | 33/168 R |
| 3,096,573 | 7/1963 | Connors et al. | 29/278 |
| 4,001,903 | 1/1977 | Hay | 81/3 R |
| 4,404,751 | 9/1983 | Rieckenberg | 33/168 R |

*Primary Examiner*—Robert C. Watson

*Attorney, Agent, or Firm*—William P. Green

[57] ABSTRACT

A tool to be used as an aid in assembling an automatic pistol and including an elongated body of resinous plastic material having a handle at one end and a projection at the opposite end usable for retaining the safety detent plunger and slide stop detent plunger in depressed condition during attachment of the safety and slide stop to the receiver of the gun, with the projection having a thickness dimension which is not over about 0.115 of an inch through a length of at least about 0.700 of an inch from an end edge of the projection, and having a width dimension greater than the thickness but not over about 0.415 of an inch through the specified length from the end edge.

7 Claims, 9 Drawing Figures

FIG. 1
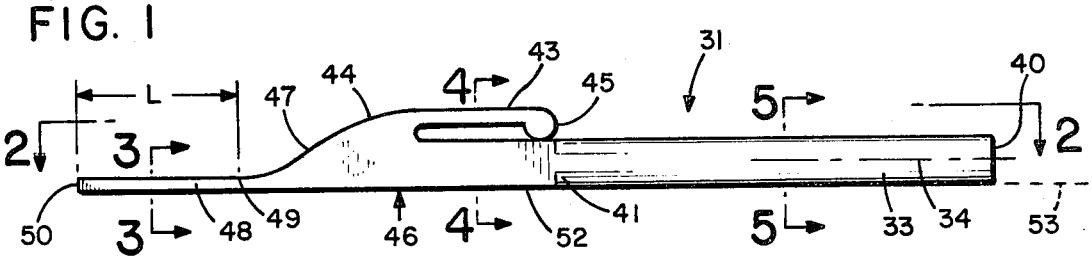
FIG. 2
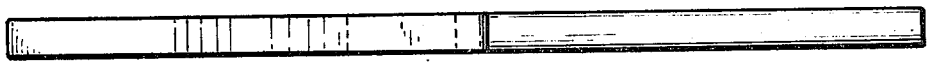
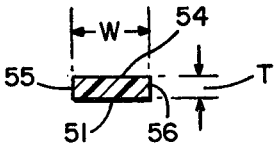
FIG. 3
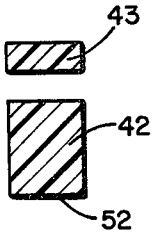
FIG. 4
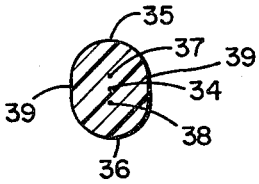
FIG. 5
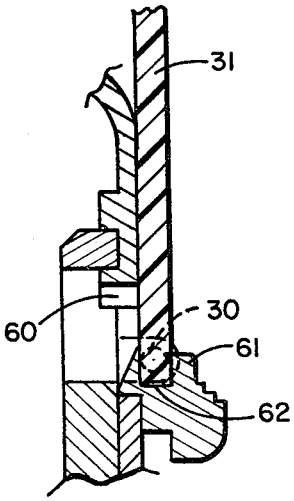
FIG. 8

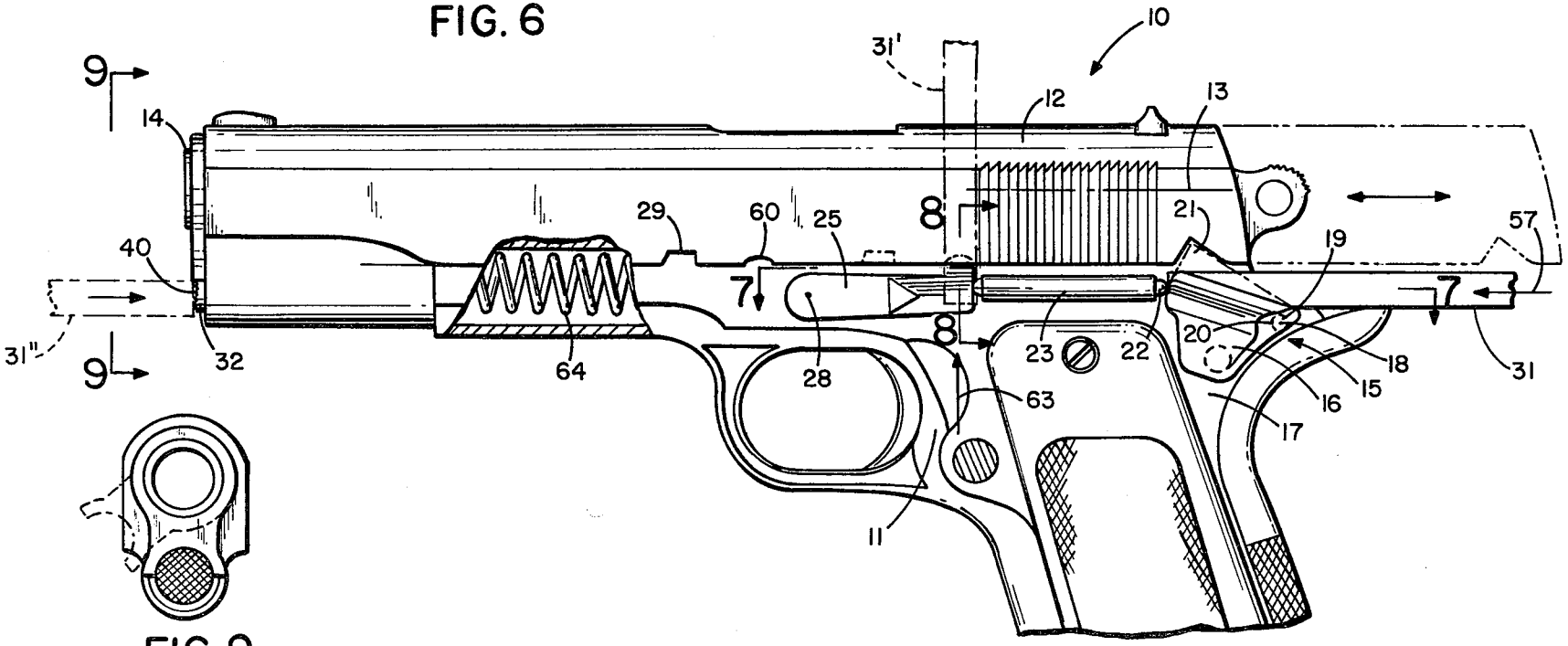
FIG. 6
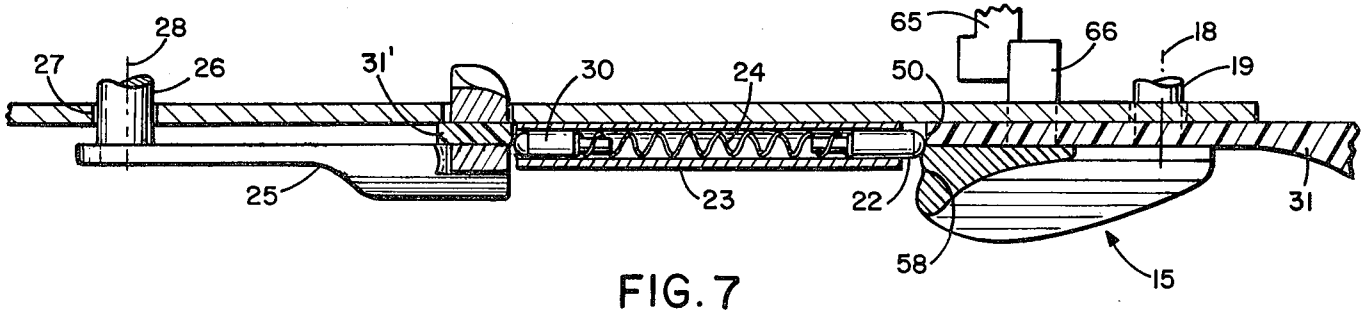
FIG. 7
FIG. 9

GUN ASSEMBLING AND DISASSEMBLING TOOL

BACKGROUND OF THE INVENTION

This invention relates to an improved tool for use in assembling an automatic pistol.

During assembly of an automatic pistol of the Colt type or the like, there are certain parts which interfit in a manner rendering them difficult to manipulate for proper interconnection. For example, the safety element, which is pivotally connected to a side of the receiver and acts to block movement of the sear and rearward movement of the slide of the gun, is detented in its active locking position and its released position by a spring pressed detent plunger, which must be held in a depressed condition as the safety is moved laterally toward the receiver during assembly. However, a person working on the gun does not have convenient access to the plunger to hold it depressed. Similarly, the detent plunger associated with the 'slide stop' which in some conditions holds the slide against forward movement often interferes with proper connection of the slide stop to the receiver of the gun.

SUMMARY OF THE INVENTION

The general object of the present invention is to provide a tool which is especially adapted for facilitating assembly of the above and other parts of an automatic pistol, to enable assembly of the pistol more rapidly and in a manner avoiding any tendency to scratch or otherwise mar the surface of the gun as may occur during attempts to assemble a gun without such a tool. The tool is designed to very easily depress the detent plunger associated with the safety element of the gun while the latter is moved to a position in which it can itself maintain the depressed condition of the plunger as the safety is pushed through a final short distance to its fully assembled position adjacent the receiver. The tool can also maintain the slide stop detent plunger in depressed condition during attachment of the slide stop to the receiver. For these purposes, the tool has a projection at one end dimensioned in a unique manner enabling its extension to locations for pressing against the two plungers. This projection has an end edge adapted to engage and depress the safety plunger, and has a thickness dimension which is small enough for reception of the projection laterally between the safety and the gun receiver while the safety is moved into very close proximity to the receiver. That thickness should be not over about 0.115 of an inch through a length of at least about 0.700 of an inch from the end edge of the projection. In a direction perpendicular to the thickness dimension, the projection has a width dimension which is greater than the thickness but not over about 0.415 of an inch through the specified length of at least about 0.700 of an inch. In order to also serve the second function of maintaining the slide stop plunger depressed during attachment of the slide stop to the receiver, the projection should have a thickness dimension near the end edge of the projection which is not over about 0.080 of an inch.

The tool has a handle portion at an end opposite that at which the projection is formed and which is utilized to manipulate the tool in moving the projection into proper relationship with the gun parts for attaining the above discussed purposes. The handle and projection are both preferably formed integrally of a resinous plastic material, having a hardness which is great enough to assure effective depression of the plungers but not hard enough to scratch or mar the surface of the gun by contact therewith.

BRIEF DESCRIPTION OF THE DRAWINGS

The above and other features and objects of the invention will be better understood from the following detailed description of the typical embodiment illustrated in the accompanying drawings in which:

FIG. 1 is a side elevational view of a tool embodying the invention;

FIG. 2 is a plan view taken on line 2—2 of FIG. 1;

FIGS. 3, 4 and 5 are transverse sections taken on lines 3—3, 4—4 and 5—5, respectively, of FIG. 1;

FIG. 6 is a fragmentary side elevational view of an automatic pistol, showing three ways that the present tool can be utilized in conjunction with the pistol;

FIGS. 7 and 8 are enlarged fragmentary sections taken on lines 7—7 and 8—8 respectively of FIG. 6; and FIG. 9 is a view on line 9—9 of FIG. 6.

DESCRIPTION OF THE PREFERRED EMBODIMENT

Referring first to FIG. 6, there is illustrated fragmentarily at 10 an automatic pistol of the Colt type having a receiver 11 to which a slide 12 is mounted for front to rear recoiling sliding movement along axis 13 upon firing of a round of ammunition within barrel 14. A conventional 'safety' element 15 has a portion 16 received adjacent the side planar surface 17 of the receiver and is mounted for pivotal movement about a transverse axis 18 by extension of a pivot pin portion 19 of the safety into an opening 20 in the receiver. The safety pivots between the full line released position of FIG. 6 and the broken line active position of that figure in which a lug 66 projecting inwardly from the safety prevents firing of the gun by engagement with the sear represented at 65, and in which position the main portion 16 of the safety is received within a notch 21 in the slide, and prevents rearward movement of the slide.

Forwardly of the location of safety 15, the receiver pivotally carries a 'slide stop' 25 having a pivot pin portion 26 extending through openings 27 in the receiver to mount the slide stop for pivotal movement about an axis 28 into and out of a notch 29 to prevent forward movement of the slide. A second detent plunger 30 which is urged forwardly by spring 24 engages slide stop 25 to releasably retain it in locked and released conditions.

The tool 31 of the present invention used in assembling the gun of FIG. 6 is illustrated in full lines in that figure as it is inserted between the safety and receiver during installation of the safety element, and is illustrated in broken lines at 31' and 31" as it may be utilized for installing the slide stop and for pressing inwardly the recoil spring plug 32 of the gun. The structure of the tool 31 is brought out in FIGS. 1 through 5. As seen in those figures, the tool is an elongated element preferably formed integrally as a single part, desirably molded of resinous plastic material. This material should be less hard than most metals, in order to avoid scratching of the surface of a gun when contacted by the tool, but should have sufficient hardness and stiffness to effectively serve its intended functions as discussed in detail hereinbelow. More particularly, the resinous plastic material should have a Shore hardness between about 40 and 90 on the D scale, and ideally have a hardness between about 70 and 80 on that scale, for best results between about 72 and 75. The presently preferred material is natural propropylene.

At its right end as viewed in FIGS. 1 and 2, the tool has a handle portion 33 extending along an axis 34 and which may be of the cross-section illustrated in FIG. 5, with upper and lower semi-cylindrically curved surfaces 35 and 36 centered about axes 37 and 38 and short parallel planar side surfaces 39 extending therebetween. At its extremity, this handle portion has a transverse planar end surface 40 disposed directly transversely of axis 34. The FIG. 5 cross-sectional configuration of the handle 33 continues from surface 40 to a location 41, beyond which the cross-section of the main body of the device is rectangular as illustrated at 42 in FIG. 4. At the upper side of this rectangular portion of the tool, the resinous plastic material is molded to form a clip 43 secured at its end 44 to the rest of the device and having a free end 45 enabling it to be clipped to a shirt pocket or the like. The rectangular cross-section of portion 42 of the tool, transversely of axis 34, has the configuration represented in FIG. 4 from the location 41 to a location 46, except as that cross-section is altered to provide clip 43 as discussed. Leftwardly beyond the location 46, the tool is progessively reduced in cross-section at 47 to form an end projection 48 which desirably has the cross-section illustrated in FIG. 3 (transversely of axis 34) from location 49 to the end edge 50 of the device. This projection 48 is essentially flat, having a planar undersurface 51 which is aligned with and a continuation of planar undersurface 52 of the rectangular portion 42 of the tool, and which lies in a plane 53 parallel to axis 34. The upper surface 54 of projection 48 is planar and parallel to undersurface 51, with two side surfaces 55 and 56 of the projection being planar and parallel to one another and perpendicular to the two surfaces 51 and 54. End edge 50 is also desirably planar, and disposed perpendicular to all of the surfaces 51, 54, 55 and 56 and to the main longitudinal axis 34 of the tool.

The thickness T of projection 48 between surfaces 51 and 54 should not be over about 0.115 of an inch in order to enable use of the tool for installation of safety 15 of FIG. 6, desirably between about 0.025 and 0.115 of an inch. To permit use of the tool for installing both the safety 15 and slide stop 25, the thickness T of FIG. 3 should be not over about 0.080 of an inch, preferably between about 0.055 and 0.075 of an inch, and for best results approximately 0.070 of an inch.

The width dimension W of FIG. 3, between edge surfaces 55 and 56 and perpendicular to longitudinal axis 34, should be substantially greater than thickness T, desirably at least several times that thickness, but not over about 0.415 of an inch in order to allow insertion of the projection to the position illustrated in full lines in the righthand portion of FIG. 6. Also, the specified thickness and width dimensions T and W should continue through a length L from end edge 50 of at least about 0.700 of an inch, and optimally at least about a full inch.

In utilizing the tool 31 for attaching safety 15 to the gun of FIG. 6, a person may first insert the pivot pin portion 19 of the safety into opening 20 in the receiver, and then move the portion 16 of the safety laterally toward the receiver as far as it will move before contacting plunger 22. The flat end portion of the tool 31 is then inserted leftwardly between portion 16 of the safety and the receiver, as indicated by the arrow 57 of FIG. 6, to a position in which the end edge 50 of projection 48 engages the plunger and presses it leftwardly in FIG. 6 against the tendency of spring 24 and beyond the left or forward edge 58 of the safety. By virtue of its small thickness dimension T as discussed, projection 48 of the tool is thin enough to allow portion 16 of the safety to move into close enough proximity to the side surface of the receiver to engage and hold plunger 22 in its leftwardly depressed condition while projection 48 of the tool remains between the safety and receiver. This condition is illustrated in FIG. 7. After the safety has been pushed into this close proximity to the receiver, and while it is held in that position to maintain the plunger in the depressed condition to which it had been pushed by the tool, the user withdraws the tool rightwardly from between the safety and receiver, so that after the tool is completely withdrawn the safety can be easily pressed inwardly along axis 18 into engagement with the side of the receiver, with the plunger in its proper condition to act as a spring pressed detent engaging the left side edge 58 of the safety.

Referring now to FIG. 8, which represents a second use of the tool 31, it is assumed in FIG. 8 that the slide has been moved to a position in which a small assembly notch 60 at the bottom edge of the slide is adjacent the slide engaging portion 61 of slide stop 25. The projection 48 of the tool can then be inserted into a notch 62 formed in portion 61 of the slide stop in a manner enabling access of the end portion of projection 48 to plunger 30 for depressing it rightwardly in FIG. 6 while the slide stop is swung upwardly to a position in which it then engages the plunger and holds it depressed. The tool can then be removed, after which the slide stop can be pushed inwardly along axis 28 to fully assembled condition. Alternatively, it is contemplated that the projection 48 may be inserted at the inner side of portion 61 of the slide stop between the slide stop and the slide, and from the upper side of the stop as viewed in FIG. 6, to hold the plunger depressed as the slide stop moves into fully assembled condition; or the tool may be inserted from the opposite direction, along the narrow 63 of FIG. 6, to form a cushion between the slide stop and the side of the receiver as the slide stop is swung upwardly and thereby prevent scratching of the surface of the receiver by the stop.

FIG. 6 represents at 31'' the manner in which the tool 31 can be utilized for pressing inwardly the recoil spring plug 32 of an automatic gun of the described type. This plug 32 is urged leftwardly in FIG. 6 by the main recoil spring 64 of the gun, at a location beneath barrel 14. To hold plug 32 in a slightly rightwardly displaced condition relative to the slide and against the tendency of the recoil spring, a user may bring the transverse right end surface 40 of tool 31 into engagement with the plug, and then press the tool rightwardly to attain the desired displacement of the plug. When the plug is thus displaced, and the slide is retracted a short distance, the barrel bushing can be turned about the barrel relative to the slide, as to the broken line position of FIG. 9, for assembly or disassembly of the parts.

It is also contemplated that the handle portion 33 of the tool 31 can be employed as an instrument for forcing the follower of an ammunition magazine for a gun of the described type to a retracted position while disassembling the magazine.

While a certain specific embodiment of the present invention has been disclosed as typical, the invention is of course not limited to this particular form, but rather is applicable broadly to all such variations as fall within the scope of the appended claims.

We claim:

1. A tool for use in assembling a gun which includes a receiver, a safety having a portion at a side of the receiver and pivotally connectable thereto, a spring pressed safety detent plunger, a slide lock, and a slide lock plunger; said tool comprising:

an elongated body of resinous plastic material having a handle portion at one end by which the tool is held and manipulated and a projection at its opposite end for holding said plungers depressed during assembly of the gun;

said projection being molded integrally with said handle and projecting therefrom essentially parallel to a predetermined axis, and terminating at an end edge of the projection which is disposed essentially transversely of said axis;

said projection being essentially flat and adapted to be inserted laterally between said receiver and said portion of the safety to a position in which said end edge of the projection engages said safety detent plunger and holds it depressed while the safety is moved into close enough proximity to the receiver to itself hold the safety detent plunger depressed while the projection is withdrawn;

said projection having two oppositely facing surfaces at opposite sides thereof extending essentially parallel to one another and to said axis and adapted to engage said receiver and said portion of the safety respectively when the projection is received therebetween;

said projection having a thickness dimension between said oppositely facing essentially parallel surfaces which is not over about 0.080 of an inch through a length of at least about 0.700 of an inch from said transverse end edge of the projection, and having a width dimension perpendicular to said thickness dimension which is substantially greater than said thickness dimension but not over about 0.415 of an inch through said length of at least about 0.700 of an inch from said end edge;

said handle portion having a thickness dimension substantially greater than that of said projection;

said resinous plastic material of which said handle and projection are molded integrally having a Shore hardness between about 70 and 80 on the D scale rendering the projection sufficiently stiff to effectively depress the plungers during assembly of the gun but not hard enough to scratch the contacted surfaces of the gun.

2. A tool as recited in claim 1, in which said resinous plastic material of which said handle and projection are formed has a Shore hardness between about 72 and 75 on the D scale.

3. A tool as recited in claim 2, in which said thickness dimension of said projection is between about 0.55 and 0.075 of an inch through said length of at least about 0.700 of an inch from said end edge.

4. A tool as recited in claim 1, in which said thickness dimension of said projection is about 0.070 through said length of at least about 0.700 of an inch from said end edge.

5. A tool as recited in claim 1, in which said projection is of essentially rectangular cross-section transversely of said axis through said length of at least about 0.700 of an inch from said end edge.

6. A tool for use in assembling a gun which includes a receiver, a safety having a portion at a side of the receiver and pivotally connectable thereto, a spring pressed safety detent plunger, a slide lock, and a slide lock plunger; said tool comprising:

an elongated body of resinous plastic material having a handle portion at one end by which the tool is held and manipulated and a projection at its opposite end for holding said plungers depressed during assembly of the gun;

said projection being molded integrally with said handle and projecting therefrom essentially parallel to a predetermined axis, and terminating at an end edge of the projection which is disposed essentially transversely of said axis;

said projection being essentially flat and adapted to be inserted laterally between said receiver and said portion of the safety to a position in which said end edge of the projection engages said safety detent plunger and holds it depressed while the safety is moved into close enough proximity to the receiver to itself hold the safety detent plunger depressed while the projection is withdrawn;

said projection being of essentially rectangular essentially uniform cross-section transversely of said axis through a length of at least about 0.700 of an inch from said transverse end edge, and having two oppositely facing surfaces at opposite sides thereof extending essentially parallel to one another and to said axis for engaging said receiver and said portion of the safety respectively when the projection is received therebetween, and having two additional oppositely facing surfaces which are generally parallel to one another and perpendicular to said first mentioned surfaces;

said projection having a thickness dimension between said two first mentioned surfaces which is between about 0.055 and 0.075 of an inch through said length of at least about 0.700 of an inch from said end edge of the projection, and having a width dimension between said additional surfaces which is at least about several times as great as said thickness dimension but not over about 0.415 of an inch through said length of at least about 0.700 of an inch from said end edge;

said handle portion having a thickness dimension substantially greater than that of said projection;

said resinous plastic material of which said handle and projection are molded integrally having a Shore hardness between about 70 and 80 on the D scale rendering the projection sufficiently stiff to effectively depress the plungers during assembly of the gun but not hard enough to scratch the contacted surfaces of the gun.

7. A tool as recited in claim 6, in which said resinous plastic material of which said handle and projection are formed has a Shore hardness between about 72 and 75 on the D scale.

* * * * *